US009677561B2

(12) United States Patent
Fischer

(10) Patent No.: US 9,677,561 B2
(45) Date of Patent: Jun. 13, 2017

(54) SIDE CHANNEL MACHINE ARRANGEMENT

(75) Inventor: Peter Fischer, Bad Neustadt (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 610 days.

(21) Appl. No.: 14/000,169

(22) PCT Filed: Feb. 16, 2012

(86) PCT No.: PCT/EP2012/052667
§ 371 (c)(1),
(2), (4) Date: Aug. 16, 2013

(87) PCT Pub. No.: WO2012/113700
PCT Pub. Date: Aug. 30, 2012

(65) Prior Publication Data

US 2014/0017064 A1 Jan. 16, 2014

(30) Foreign Application Priority Data

Feb. 22, 2011 (DE) ..... 10 2011 004 512

(51) Int. Cl.
*F04D 5/00* (2006.01)
*F04D 23/00* (2006.01)
*F04D 29/42* (2006.01)

(52) U.S. Cl.
CPC ..... *F04D 5/007* (2013.01); *F04D 23/008* (2013.01); *F04D 29/4206* (2013.01)

(58) Field of Classification Search
CPC .... F04D 23/008; F04D 29/4206; F04D 5/007; F04D 5/00; F04D 5/002; F04D 29/4213
(Continued)

(56) References Cited

U.S. PATENT DOCUMENTS 4,408,952 A 10/1983 Schweinfurter

FOREIGN PATENT DOCUMENTS

| | | | |
|---|---|---|---|
| DE | 10015671 | A1 | 11/2000 |
| DE | 10 2007 017915 | A1 | 10/2008 |
| EP | 0 070 530 | A1 | 1/1983 |
| EP | 0 097 924 | A2 | 1/1984 |
| EP | 2166232 | A1 | 3/2010 |
| JP | S5738693 | A | 3/1982 |

(Continued)

OTHER PUBLICATIONS

English Machine translation of DE 2007 017 915 A (translated on Nov. 30, 2015).*

(Continued)

*Primary Examiner* — Mark A Laurenzi
*Assistant Examiner* — Paul Thiede
(74) *Attorney, Agent, or Firm* — Michael Best & Friedrich LLP

(57) ABSTRACT

A side channel machine arrangement comprises a side channel machine (1) and a fluid connection device (2). The side channel machine (1) has a housing (5), side channels arranged in the housing (5) and fluid inlet openings (11) provided in said housing, which have a flow connection to the side channels to introduce a fluid to be conveyed into the side channels, at least one fluid outlet, which is provided on the housing (5) and has a flow connection to the side channels to discharge the fluid from the side channels, and an impeller that is mounted so that it can be rotatably driven in the housing (5). The fluid connection device (2) is used to connect the side channel machine (1) to a fluid supply line. It comprises a first fluid connection mechanism (3), which is provided on the housing (5) and has a flow connection to the fluid inlet openings (11), and a second fluid connection mechanism (4), which has a fluid inlet piece (29) for connection to the fluid supply line.

18 Claims, 4 Drawing Sheets

Figure 1:
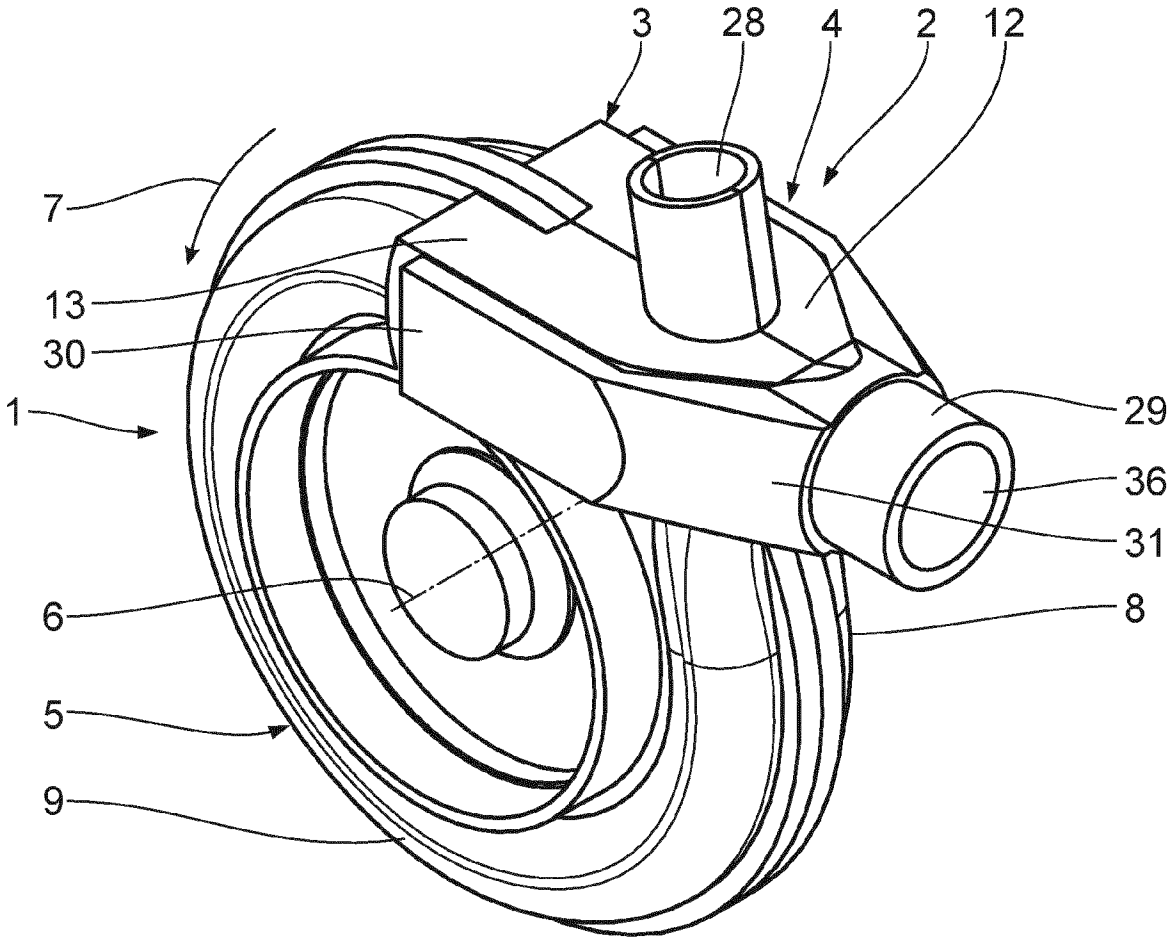

(58) Field of Classification Search
USPC ..... 415/55.1, 93, 55.2, 55, 3, 55.4, 55.5, 415/55.6, 55.7
See application file for complete search history.

(56) References Cited

FOREIGN PATENT DOCUMENTS

| | | | |
|---|---|---|---|
| JP | H03119593 | U | 12/1991 |
| JP | H06167292 | A | 6/1994 |
| JP | 2000303928 | A | 10/2000 |
| JP | 2006525460 | A | 11/2006 |
| WO | WO 2008/119769 | A1 | 10/2008 |

OTHER PUBLICATIONS

Office Action with English translation from the Japanese Patent Office for Application No. 2013-553940 dated Nov. 4, 2015 (6 pages).
English translation of Abstract for EP 0 097 924 (2 pages).
English translation of Abstract for EP 0 070 530 (2 pages).
English translation of Abstract for DE 10 2007 017 915 A1 (1 page).
International Preliminary Report on Patentability regarding international application PCT/EP2012/052667 (40 pages) completed Jul. 22, 2013.
Written Opinion of the International Preliminary Examining Authority related to international application PCT/EP2012/052667 (7 pages) mailed Jun. 4, 2013.
Response to the Written Opinion of the International Preliminary Examining Authority (7 pages) related to international application PCT/EP2012/052667 mailed Jun. 28, 2013.
Written Opinion of the International Searching Authority related to international application PCT/EP2012/052667 (6 pages).
International Search Report related to international case PCT/EP2012/052667 (4 pages) mailed May 22, 2012.
Office Action concerning DE priority case 10 2011 004 512.0 rejecting Claim 1 as unpatentable over U.S. Pat. No. 4,408,952 and advising claims 5,7 and 12 as patentable over the prior art mailed Dec. 5, 2011.

* cited by examiner

SIDE CHANNEL MACHINE ARRANGEMENT

The invention relates to a side channel machine arrangement for conveying a fluid, in particular a gaseous fluid. The side channel machine arrangement comprises a side channel machine with side channels and a fluid connection device for connecting the side channel machine to a fluid supply line.

Side channel machine arrangements are known in general from the prior art and from public prior use. In general, the side channel machines have fluid inlet connections upstream with respect to their side channels. A Y-pipe section is generally connected to the two fluid inlet connections of a side channel machine, an outer fluid supply line being in turn connected to said Y-pipe section. Seals are necessary between the coupling pipe section and the fluid inlet connections, in order to prevent an undesired escape of fluid.

An object of the invention is to provide a side channel machine arrangement, in which a fluid supply line can be connected extremely easily and economically and in a fluid-tight manner to a side channel machine. The fluid connection device of the side channel machine arrangement should itself furthermore be particularly economical to produce. Moreover, the side channel machine arrangement should have an extremely high degree of efficiency.

This object is achieved according to the invention by a side channel machine arrangement for conveying a fluid, in particular a gaseous fluid, comprising a side channel machine with a housing, with side channels arranged in the housing, with fluid inlet openings, which are provided in the housing and have a flow connection to the side channels to introduce a fluid to be conveyed into the side channels, with at least one fluid outlet, which is provided on the housing and has a flow connection to the side channels for discharging the fluid from the side channels, and with an impeller, which is mounted so as to be rotatably driveable in the housing, to convey the fluid in the side channels, and a fluid connection device for connecting the side channel machine to a fluid supply line, comprising a first fluid connection mechanism, which is provided on the housing and has a flow connection to the fluid inlet openings, and a second fluid connection mechanism, which has a fluid inlet piece for connection to the fluid supply line, has a fluid-tight connection to the first fluid connection mechanism, and with the first fluid connection mechanism, limits a fluid connection space. As noted above the invention has a fluid connection device comprising a first fluid connection mechanism on the housing side and a second fluid connection mechanism, which has a fluid-tight connection to the first fluid connection mechanism and a fluid inlet piece for connection to a fluid supply line.

The first fluid connection mechanism and the second fluid connection mechanism may have a detachable or non-detachable connection to one another. The type of connection preferably depends on the material of the fluid connection device. If the fluid connection device is produced from a metallic cast material, a screw connection with at least one connection screw between the fluid connection mechanisms or between the second fluid connection mechanism and the housing is preferred. On the other hand, a clamping, latching or snap-on connection between the fluid connection mechanisms or between the second fluid connection mechanism and the housing is preferably used if the fluid connection device is formed from sheet metal or a plastics material. An adhesive, welded, soldered, plug, bolt or nail connection is optionally alternatively possible between the fluid connection mechanisms or between the second fluid connection mechanism and the housing, depending on the material of the fluid connection device.

The side channels preferably run in annular manner. Two side channels are advantageously present.

The first fluid connection mechanism and/or the second fluid connection mechanism is/are advantageously symmetrical with respect to at least one centre plane of symmetry.

The side channel machine is preferably a side channel fan to convey gas, such as air.

Further, the object is achieved according to the invention by a side channel machine arrangement for conveying a fluid, in particular a gaseous fluid, comprising a side channel machine with a housing, with side channels arranged in the housing, with fluid inlet openings, which are provided in the housing and have a flow connection to the side channels to introduce a fluid to be conveyed into the side channels, with at least one fluid outlet, which is provided on the housing and has a flow connection to the side channels for discharging the fluid from the side channels, and with an impeller, which is mounted so as to be rotatably driveable in the housing, to convey the fluid in the side channels, and a fluid connection device for connecting the side channel machine to a fluid supply line, comprising a first fluid connection mechanism, which is provided on the housing and has a flow connection to the fluid inlet openings, has a first limiting wall limiting the fluid connection space, has a second limiting wall, which limits the fluid connection space and preferably runs opposing the first limiting wall, and is laterally open to the outside on both sides between the first limiting wall and the second limiting wall, and a second fluid connection mechanism, which has a fluid inlet piece for connection to the fluid supply line, has a fluid-tight connection to the first fluid connection mechanism, and with the first fluid connection mechanism, limits a fluid connection space.

Further, the object is achieved according to the invention by a side channel machine arrangement for conveying a fluid, in particular a gaseous fluid, comprising a side channel machine with a housing, with side channels arranged in the housing, with fluid inlet openings, which are provided in the housing and have a flow connection to the side channels to introduce a fluid to be conveyed into the side channels, with at least one fluid outlet, which is provided on the housing and has a flow connection to the side channels for discharging the fluid from the side channels, and with an impeller, which is mounted so as to be rotatably driveable in the housing, to convey the fluid in the side channels, and a fluid connection device for connecting the side channel machine to a fluid supply line, comprising a first fluid connection mechanism, which is provided on the housing and has a flow connection to the fluid inlet openings, and a second fluid connection mechanism, which has a fluid inlet piece for connection to the fluid supply line, has a fluid-tight connection to the first fluid connection mechanism, with the first fluid connection mechanism, limits a fluid connection space, and is substantially clamp-like and closes the first fluid connection mechanism, at least laterally to the outside.

Further, the object is achieved according to the invention by a side channel machine arrangement for conveying a fluid, in particular a gaseous fluid, comprising a side channel machine with a housing, with side channels arranged in the housing, with fluid inlet openings, which are provided in the housing and have a flow connection to the side channels to introduce a fluid to be conveyed into the side channels, with at least one fluid outlet, which is provided on the housing and has a flow connection to the side channels for discharging the fluid from the side channels, and with an impeller, which is mounted so as to be rotatably driveable in the housing, to convey the fluid in the side channels, and a fluid connection device for connecting the side channel machine to a fluid supply line, comprising a first fluid connection mechanism, which is provided on the housing and has a flow connection to the fluid inlet openings, and has a second fluid connection mechanism, which has a fluid inlet piece for connection to the fluid supply line, has a fluid-tight connection to the first fluid connection mechanism, with the first fluid connection mechanism, limits a fluid connection space, has two mutually opposing side limiting walls to limit the fluid connection space laterally to the outside on both sides, and is open downstream with respect to the fluid inlet piece between the side limiting walls.

Preferably, the first fluid connection mechanism and the second fluid connection mechanism have a positive connection to one another. That configuration produces an extremely secure and fluid-tight connection between the fluid connection mechanisms.

Preferably, the first fluid connection mechanism has a first limiting wall limiting the fluid connection space. The first limiting wall preferably directly adjoins the housing. It is preferably an inner limiting wall.

Preferably, the first fluid connection mechanism has a second limiting wall, which limits the fluid connection space and preferably runs opposing the first limiting wall. The second limiting wall is advantageously an outer limiting wall. The limiting walls preferably run parallel to one another, at least in portions.

Preferably, the first fluid connection mechanism is laterally open to the outside on both sides between the first limiting wall and the second limiting wall. That configuration allows extremely simple and economical manufacturing of the first fluid connection mechanism. The first fluid connection mechanism can thus be produced, for example, by a metal casting method without a core/cores or slide.

Preferably, the first fluid connection mechanism has a separating wall, which is arranged at least upstream with respect to the fluid inlet openings, for the spatially separate guidance of the fluid to the respective side channel. The separating wall also leads to a division of the fluid over the side channels. It is advantageous from technical flow points of view.

Preferably, the second fluid connection mechanism is substantially clamp-like and closes the first fluid connection mechanism, at least laterally to the outside. The clamp-like configuration of the second fluid connection mechanism allows an extremely secure and tight and easy to produce connection to the first fluid connection mechanism. A second fluid connection mechanism configured in this manner is furthermore particularly economical and easy to produce. It is advantageous if the second fluid connection mechanism closes the first fluid connection mechanism laterally on both sides and optionally also at the front adjacent to the fluid inlet piece.

Preferably, the side limiting walls are substantially plate-like in each case. That configuration also leads to a very economically producible second fluid connection mechanism.

Preferably, the second fluid connection mechanism, downstream with respect to the fluid inlet piece, has a transition region, in which the side limiting walls diverge, at least on the inside. That configuration brings about an increase, preferably a slight increase, in the flow speed of the fluid in the transition region in the flow direction. The pressure of the fluid then drops in the transition region. This is advantageous for technical flow reasons. The side limiting walls diverge for this purpose in the transition region going away from the fluid inlet piece. Downstream and/or upstream from the transition region, the fluid connection device is advantageously configured in such a way that the fluid has a substantially constant flow speed, or one which increases in the flow direction, preferably slightly. It is furthermore advantageous if the side limiting walls are configured in such a way that they draw together or toward one another from the fluid inlet piece or the transition region, which increases the sealing effect. The side limiting walls are therefore virtually pressed together. This can be achieved, for example, by a corresponding prestressing or resilient configuration of the side limiting walls.

Preferably, the second fluid connection mechanism is open downstream with respect to the fluid inlet piece between the side limiting walls. Preferably, the second fluid connection mechanism is open at the downstream side opposing the fluid inlet piece. These second fluid connection mechanisms can also be produced extremely easily and economically. They can preferably be produced by a metal casting method without a core/cores or slide.

Preferably, the side limiting walls, preferably laterally to the outside, adjoin the first limiting wall and the second limiting wall to spatially limit the fluid connection space. That configuration produces a particularly fluid-tight fluid connection device.

Preferably, the fluid inlet piece has precisely one fluid inlet opening. That configuration consequently means that only very few seals or sealing devices are necessary in the fluid connection device. A side channel machine arrangement of this type can therefore also be provided in an extremely customer-friendly and economical manner. A seal is necessary on the fluid inlet piece. A further seal is preferably arranged on a fluid outlet pipe body adjacent to the fluid outlet.

Figure 2:
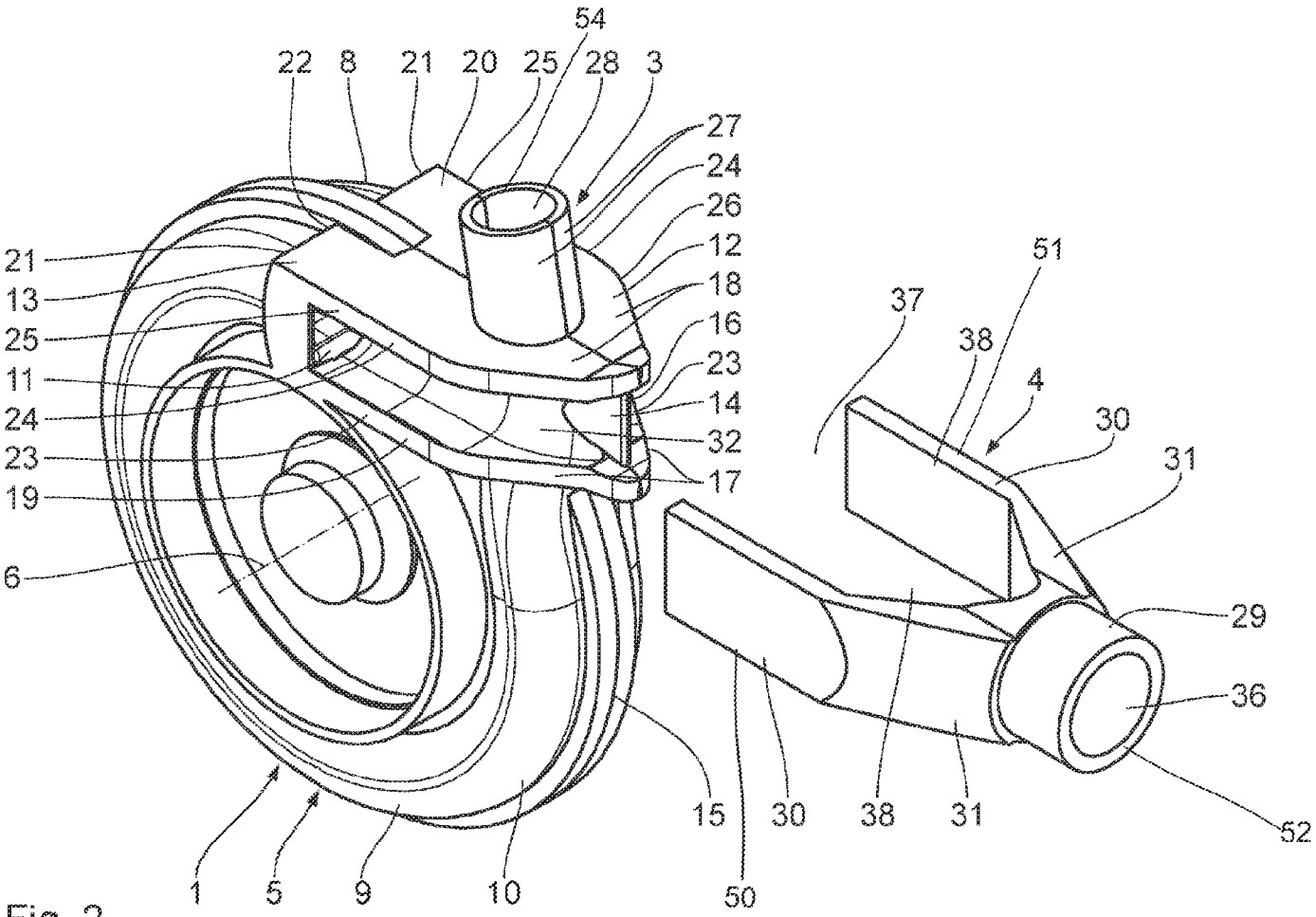
Figure 3:
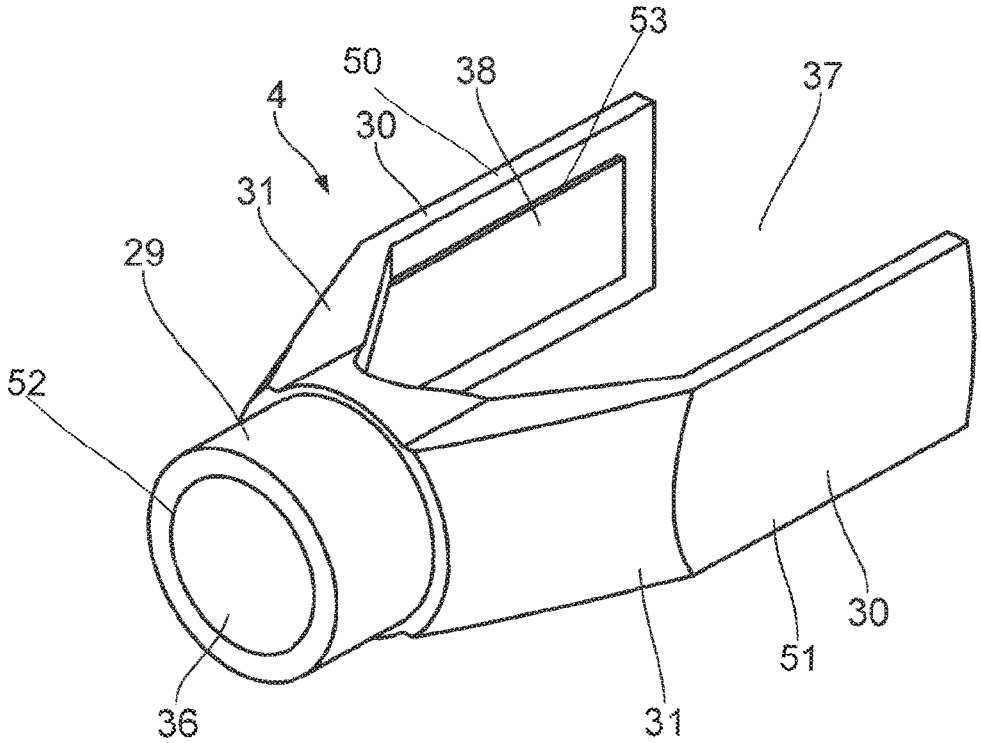
Figure 4:
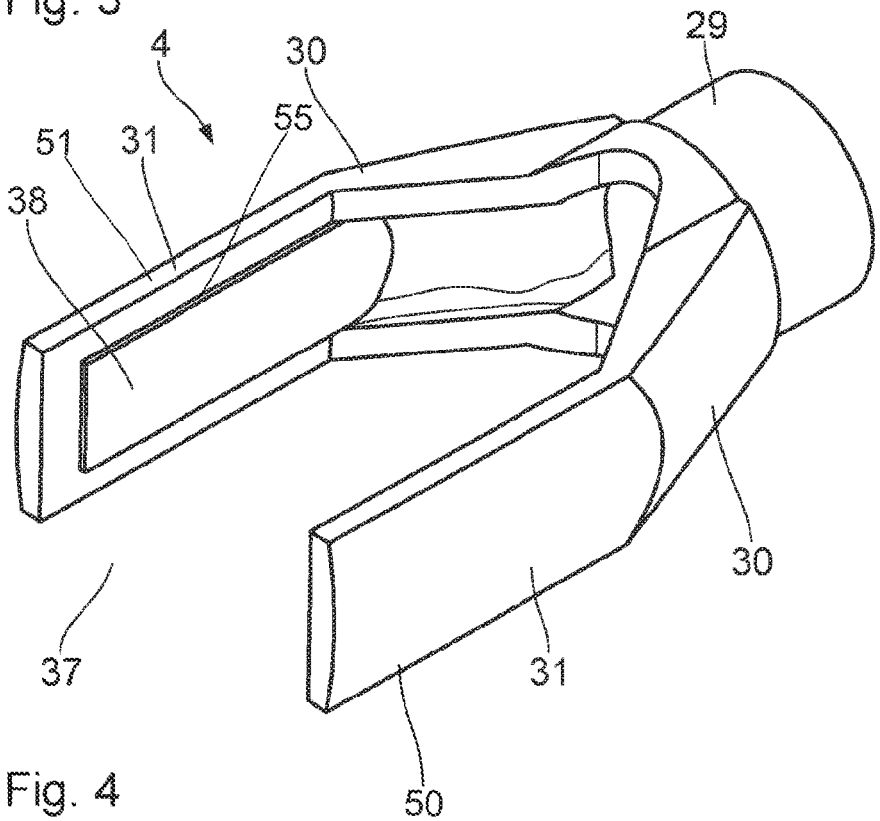

Two preferred embodiments of the invention will be described by way of example below with reference to the accompanying drawings, in which:

FIG. 1 shows a perspective view of a side channel machine arrangement according to the invention in accordance with a first embodiment, FIG. 2 shows an exploded view of the side channel machine arrangement shown in FIG. 1, FIGS. 3 and 4 show perspective views of the second fluid connection mechanism of the side channel machine arrangement shown in FIGS. 1 and 2, and FIGS. 5 and 6 show perspective views of an alternative, second fluid connection mechanism.

A side channel machine arrangement shown in its entirety in FIGS. 1 and 2 comprises a side channel machine 1 and a fluid connection device 2, which is arranged on the outside of the side channel machine 1 and is formed from a rigid material. The side channel machine 1 is a side channel fan. The fluid connection device 2 has a first fluid connection mechanism 3, which is provided directly on the side channel machine 1, and a second fluid connection mechanism 4, which has a first fluid-tight connection to the first fluid connection mechanism 3. The fluid connection device 2 is used to connect the side channel machine 1 to an outer fluid supply line (not shown), in which a fluid to be conveyed is guided during operation.

The side channel machine 1 comprises an impeller (not shown), which is provided with impeller blades and is rotatably mounted about a centre axis 6 in a housing 5 of the side channel machine 1. A conventional drive, which is not shown in the figures and is preferably flanged onto the housing 5, is used to rotatably drive the impeller in the direction of the arrow 7. The drive may be an electric drive. The fluid can be conveyed in the housing 5 in the direction of the arrow 7.

The housing 5 comprises a housing body 8 and a housing cover 9, which can preferably be removed from the housing body 8. The housing body 8 and the housing cover 9 are shown joined together in FIG. 1, 2. In the joined state, they together surround the rotatably drivable impeller, which is arranged in a rotational fixed manner on a drive shaft (not shown), with the impeller blades. The drive shaft has a drive connection to the drive. The housing body 8 and the housing cover 9 each have a substantially circular outer shape.

The impeller is substantially circular disc-like. It comprises an inner impeller hub with a central, cylindrical hub bore. A radial circular ring-like hub disc adjoins the impeller hub. Arranged on the hub disc is a plurality of impeller blades, which protrude radially and preferably have an identical angular spacing from one another. The hub bore is used to receive the drive shaft. To transmit a torque from the drive shaft to the impeller hub for the rotation of the impeller, a conventional feather key connection is advantageously provided between the drive shaft and the impeller hub.

Both the housing body 8 and the housing cover 9 have a radially outer, peripheral channel portion 10, which may be formed by a curved piece. In the joined state of the housing 5, the two channel portions 10 outwardly limit two side channels or flows, which are arranged adjacent to one another in the direction of the centre axis 6 and adjoin one another here. The side channels extend spaced apart annularly about the centre axis 6.

A fluid inlet opening 11, which has a flow connection to the side channels, is provided in each case in the housing body 8 and in the housing cover 9. The fluid inlet openings 11 are arranged adjacent to one another. They are located in an identical peripheral region of the housing 5.

A fluid outlet, which has a flow connection to the side channels, is also provided in the housing body 8 and in the housing cover 9.

The first fluid connection mechanism 3 is formed on the housing 5 according to this embodiment. However, it can also be configured separately and fastened accordingly to the housing 5. The first fluid connection mechanism 3 is configured symmetrically with respect to a first centre plane of symmetry, which runs between the housing body 8 and the housing cover 9. In this case, a first fluid connection mechanism half 12 is associated with the housing body 8 and a second fluid connection mechanism half 13 of the first fluid connection mechanism 3 is associated with the housing cover 9. The fluid connection mechanism halves 12, 13 are provided at the fluid inlet openings 11 and the fluid outlet.

Each fluid connection mechanism half 12, 13 has an inner separating wall element 14, which extends from the housing body 8 or 9 radially outwardly adjacent to a connecting region 15 between the housing body 8 and the housing cover 9. The separating wall elements 14, in this case, merely run over a spatially limited peripheral region of the housing 5 along the connecting region 15. They rest on one another in the assembled state of the housing 5 or the first fluid connection mechanism 3 and run parallel to one another. The separating wall elements 14 end adjacent to the fluid inlet openings 11. Together they form a separating wall 16. The fluid connection mechanism halves 12, 13 are in each case laterally open to the outside with respect to the respective separating wall element 14. The fluid connection mechanism is therefore substantially open on both sides in the direction of the centre axis 6. It is also open at an upstream fluid inlet side.

Furthermore, each fluid connection mechanism half 12, 13 has a first limiting wall element 17 and a second limiting wall element 18, which oppose one another and run substantially parallel to one another, at least in regions. The first limiting wall elements 17 of the two fluid connection mechanism halves 12, 13 are arranged closer to the centre axis 6 than the second limiting wall elements 18 of the fluid connection mechanism halves 12, 13. The first limiting wall elements 17 align with one another, in this case, in the assembled state of the housing 5 or the first fluid connection mechanism 3. They run substantially tangentially with respect to the side channels. The second limiting wall elements 18 also align with one another in the assembled state of the housing 5 or the fluid connection mechanism 3. The first limiting wall elements 17 together form a first limiting wall 19. The second limiting wall elements 18, on the other hand, together form a second limiting wall 20.

Each fluid connection mechanism half 12, 13, downstream with respect to the associated fluid inlet opening 11, has a terminating wall element 21, which runs radially outwardly from the housing 5 adjacent to the respective fluid inlet opening 11. The terminating wall elements 21 extend substantially perpendicular to the limiting wall elements 17 and the limiting wall elements 18. They also run substantially perpendicular to the separating wall elements 14. The terminating wall elements 21 extend between the first limiting wall elements 17 and the second limiting wall elements 18. In the assembled state of the housing 5 or the first fluid connection mechanism 3, the terminating wall elements 21 align with one another and together form a terminating wall 22, which extends substantially perpendicular to the peripheral direction of the side channels.

Each limiting wall element 17, 18 has a lateral, outer side flank 23 or 24, which is remote from the connecting region 15. The side flanks 23, 24 of a fluid connection mechanism half 12 or 13 align with one another. In a region 25 adjacent to the terminating wall element 21, the side flanks 23, 24 of the fluid connection mechanism halves 12, 13 run parallel to one another. In an upstream transition region 26 adjacent to the region 25, the side flanks 23, 24 of the two fluid connection mechanism halves 12, 13 run together from the region 25. The side flanks 23 of the first limiting wall 19 oppose one another. The side flanks 24 of the second limiting wall 20 also oppose one another.

In the transition region 26 or adjacent thereto, each fluid connection mechanism half 12, 13 has a tube body element 27. The tube body elements 27, in the assembled state of the housing 5 or the first fluid connection mechanism 3, form a tube body 28, which is cross sectionally circular ring-like and has a flow connection with the side channels. For this purpose, a corresponding connecting channel, which adjoins the fluid outlet of the side channel machine 1, is provided in the separating wall 16. The tube body 28 runs substantially tangentially to the side channels. It extends substantially perpendicular to the second limiting wall 20 and is arranged thereon.

The first fluid connection mechanism 3—but excepting the tube body 28—is also substantially symmetrical with respect to a second centre plane of symmetry, which extends perpendicular to the first centre plane of symmetry between the first limiting wall 19 and the second limiting wall 20.

The first limiting wall element 17, the second limiting wall element 18, the separating wall element 14 and the terminating wall element 21 and the tube body element 27 of the fluid connection mechanism 3 or 4 are configured in one piece, in each case.

The second fluid connection mechanism 4 is symmetrical with respect to a third centre plane of symmetry and a fourth centre plane of symmetry, which run perpendicular to one another. It is clamp-like.

The second fluid connection mechanism 4 comprises a fluid inlet piece 29 arranged upstream, which is configured in a tube-like manner. It is preferably configured in a circular ring-like manner in cross section. The fluid inlet piece 29 has precisely one fluid inlet opening 36, which is preferably circular in cross section and may include a seal 52.

The second fluid connection mechanism 4 also has a first arm 50 and a second arm 51 that each include a rigid side limiting wall 30, which together adjoin the fluid inlet piece 29 downstream and diverge on the inside from the latter in a transition region 31 adjacent to the fluid inlet piece 29. The third centre plane of symmetry runs between the side limiting walls 30. The side limiting walls 30 run parallel with respect to one another downstream with respect to the transition region 31.

The second fluid connection mechanism 4 is open at a side 37 opposing the fluid inlet piece 29. It is also open substantially with respect to two further sides 38, which run parallel to one another and perpendicular to the third centre plane of symmetry. The sides 38 are present between the side limiting walls 30.

The side limiting walls 30 are adapted on the inside to the course of the side flanks 23, 24. They are substantially plate-like. The side limiting walls 30 run substantially in clamp-like manner or in the form of a U. The height of the side limiting walls 30 substantially corresponds to the outer spacing of the limiting walls 19, 20 from one another.

If the side channel machine arrangement or the fluid connection device 2 is in its assembled state, the first fluid connection mechanism 3 and the second fluid connection mechanism 4 have a positive and fluid-tight connection to one another. In this case, the side flanks 23, 24 of the first fluid connection mechanism 3 rest in a fluid-tight manner on the inside of the side limiting walls 30 of the second fluid connection mechanism 4. A seal 53, 55 can be additionally provided there. The second fluid connection mechanism 4 closes the first fluid connection mechanism 3 by its side limiting walls 30 laterally to the outside in the direction of the centre axis 6 and at the front adjacent to the fluid inlet piece 29. A limited fluid connection space is thus formed in the fluid connection device 2. The fluid connection space has two fluid inlet channels 32, which run substantially tangentially to the side channels.

A first fluid inlet channel 32 is present in the first fluid connection mechanism half 12. It is limited substantially radially with respect to the centre axis 6 by the limiting wall elements 17, 18. The first fluid inlet channel 32 is limited in the direction of the centre axis 6 by the separating wall element 14 and the adjacent side limiting wall 30.

A second fluid inlet channel 32 is present in the second fluid connection mechanism half 13. In an analogous manner, it is limited by the limiting wall elements 17, 18 and the separating wall element 14 and the adjacent side limiting wall 30. The second fluid inlet channel 32 extends along the first fluid inlet channel 32.

To assemble the second fluid connection mechanism 4, the latter is to be pushed onto the first fluid connection mechanism 3. As already mentioned at the outset, the second fluid connection mechanism 4 is detachably or non-detachably fixable in various manners to the first fluid connection mechanism 3.

The operation of the side channel machine arrangement will be described in more detail below. During operation of the side channel machine arrangement, an external fluid supply line (not shown) is connected in a fluid-tight manner to the fluid inlet piece 29. The fluid supply line is preferably pushed onto the fluid inlet piece 29 on the outside. The drive shaft is made to rotate in the direction of the arrow 7 about the centre axis 6 by the drive. In this case, the impeller coupled in a rotatably fixed manner to the drive shaft is also made to rotate with the impeller blades in the direction of the arrow 7.

The fluid, which is gaseous here, leaves the fluid supply line via the fluid inlet opening 36 and enters the fluid inlet piece 29. It then flows into the fluid connection device 2 and is divided therein over the two fluid inlet channels 32. The fluid flows into the fluid inlet channels 32 and along them. In the fluid connection device 2, it passes on the inside along the side limiting walls 30, the separating wall 16 and the limiting walls 19, 20. The terminating wall 22 guides the fluid into the fluid inlet openings 11.

The impeller blades passing the fluid inlet openings 11 suck the fluid to be conveyed via the fluid inlet openings 11 from the fluid inlet channels 32 into the side channels.

The impeller blades then accelerate the fluid located in the side channels in the direction of the arrow 7, which can therefore also be called the transporting arrow. The fluid is, in this case, contained in cells, which are limited in the peripheral direction by adjacent impeller blades. At the end of the revolution, the impeller blades eject the fluid again from the side channels via the tube body 28 (e.g., such that the tube body 28 forms at least a portion of the fluid outlet), which has a flow connection via the connecting channel and the fluid outlet to the side channels. The fluid, in this case, in the side channel machine 1, has covered an angular path of about 290° to 320°. An interrupter in the side channels prevents the fluid transported by the impeller inside the side channels being transported further from the tube body 28 to the fluid inlet openings 11. The tube body 28 extends substantially perpendicular to the fluid inlet channels 32.

Figure 5:
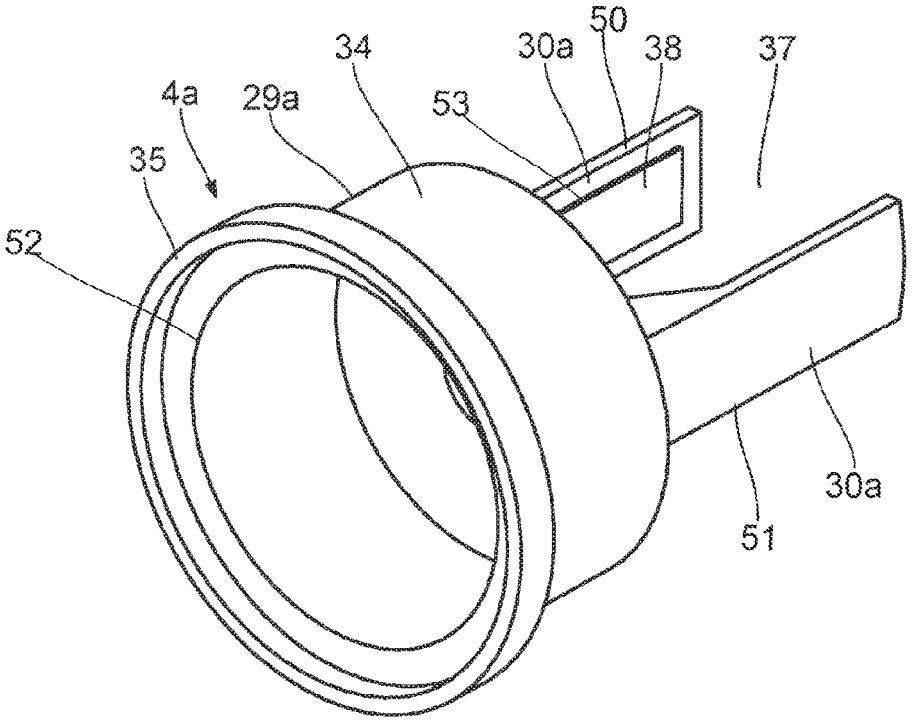
Figure 6:
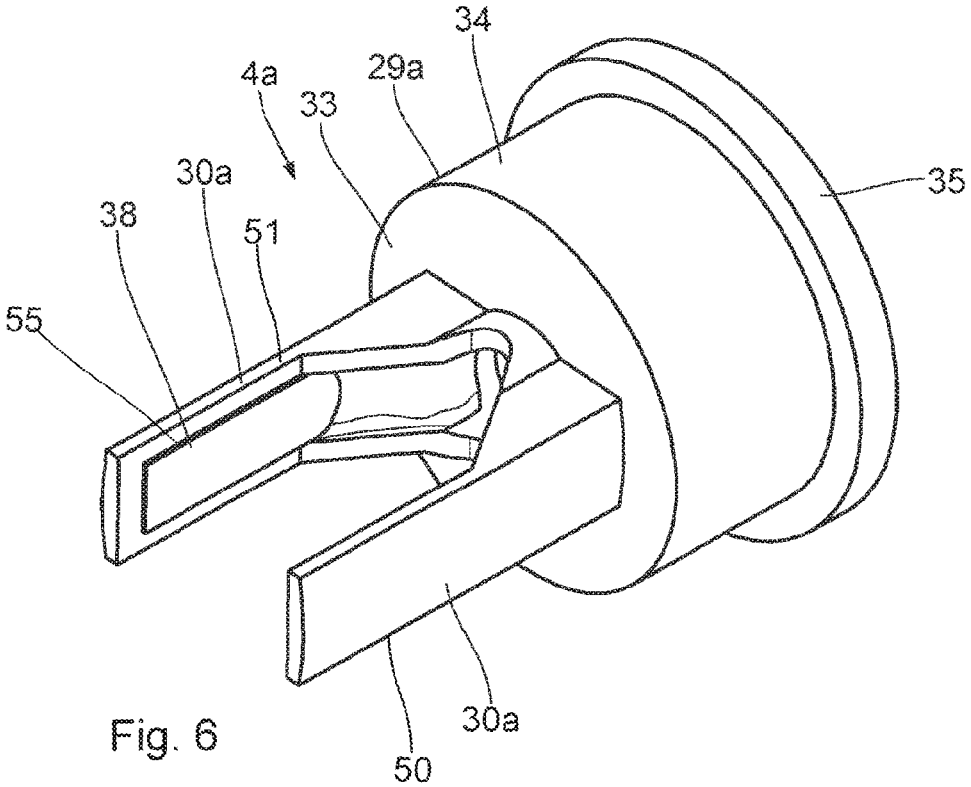

Referring to FIGS. 5 and 6, a second embodiment of the invention will now be described. Identical parts have the same reference numerals as in the first embodiment, to which reference is hereby made. Structurally different, but functionally similar parts have the same reference numerals with an "a" arranged thereafter.

Compared with the previous embodiment, the second fluid connection mechanism **4*a* here has a fluid inlet piece 29*a*, which is pot-like. The fluid inlet piece 29*a* is substantially larger in its transverse dimension than the fluid inlet piece 29 according to the first embodiment. At least one filter element and/or sound absorber element (not shown), which the fluid to be conveyed can flow through or round, is received in the housing-like fluid inlet piece 29*a***.

The fluid inlet piece **29*a* has a downstream base 33 and a side wall 34 going out from the base 33 at the edge. Opposite the base 33, an end-side terminating edge 35 adjoins the side wall 34. Downstream with respect to the base 33, the side limiting walls 30*a* adjoin the fluid inlet piece 29*a***.

The side channel machine arrangement can be manufactured extremely easily by the metal casting method. The fluid connection device 2 can be produced without a core or slide by the metal casting method.

The side channel machine arrangement according to the invention requires only an extremely low sealing outlay.

Precisely one seal 52 is necessary on the fluid inlet piece 29, 29*a* and precisely one seal 54 on the tube body 28. Furthermore, the side channel machine arrangement has an extremely compact structural form, resulting in particularly low coefficients of friction.

What is claimed is:

1. A side channel machine arrangement for conveying a fluid, in particular a gaseous fluid, comprising:

a) a side channel machine i) with a housing, ii) with side channels arranged in the housing, iii) with fluid inlet openings, which are provided in the housing and have a flow connection to the side channels to introduce a fluid to be conveyed into the side channels, and iv) with at least one fluid outlet, which is provided on the housing and has a flow connection to the side channels for discharging the fluid from the side channels, b) a fluid connection device for connecting the side channel machine to a fluid supply line, comprising i) a first fluid connection mechanism, which is provided on the housing, has first limiting walls and second limiting walls opposite the first limiting walls defining fluid connection spaces, and has a flow connection to the fluid inlet openings, and ii) a second fluid connection mechanism, which has a fluid-tight connection to the first fluid connection mechanism, and with the first fluid connection mechanism, limits the fluid connection spaces, and c) the fluid connection spaces are between the first limiting walls and the second limiting walls, and d) the second connection mechanism includes a first arm and a second arm that each engage the first connection mechanism to seal the fluid connection spaces of the first fluid connection mechanism.

2. The side channel machine arrangement according to claim 1, wherein the first fluid connection mechanism has a separating wall, which is arranged at least upstream with respect to the fluid inlet openings, for the spatially separate guidance of the fluid to the respective side channel.

3. The side channel machine arrangement according to claim 1, wherein the first arm and the second arm each include side limiting wall, the side limiting walls facing one another to engage the first fluid connection mechanism.

4. The side channel machine arrangement according to claim 3, wherein each of the side limiting walls is substantially planar.

5. The side channel machine arrangement according to claim 3, wherein the side limiting walls run parallel to one another.

6. The side channel machine arrangement according to claim 3, wherein the second fluid connection mechanism includes a transition region extending between and coupling the first arm to the second arm.

7. The side channel machine arrangement according to claim 3, wherein the second fluid connection mechanism is open between the side limiting walls downstream from a fluid inlet piece on the second fluid connection mechanism.

8. The side channel machine arrangement according to claim 1, wherein the second fluid connection mechanism is open at the downstream side opposite a fluid inlet piece of the second fluid connection mechanism.

9. The side channel machine arrangement according to claim 1, wherein the first arm and the second arm engage and extend between the first limiting walls and the second limiting walls to seal the fluid connection space.

10. The side channel machine arrangement according to claim 1, wherein the second connection mechanism has a fluid inlet piece having only one fluid inlet opening.

11. A side channel machine for conveying a fluid, the side channel machine comprising:

a housing defining a fluid inlet fluidly coupled to a fluid outlet via a side channel configuration, the fluid inlet being at least partially defined by a first fluid connector having a pair of opposed first and second limiting walls separated by a separating wall to cooperatively delimit a first fluid connection space and a second fluid connection space; and a second fluid connector including a first arm and a second arm configured to be received within the first fluid connection space and the second fluid connection space, respectively, and to form a fluid-tight connection with the first fluid connector, wherein the second fluid connector further includes a fluid inlet piece fluidly coupled to the first and second arm via a diverging transition region.

12. The side channel machine of claim 11, wherein the fluid inlet piece includes a seal.

13. The side channel machine of claim 12, wherein the seal on the fluid inlet piece is the only seal associated with the second fluid connector.

14. The side channel machine of claim 11, wherein the first arm and the second arm each include a seal to sealingly engage the first and second limiting walls of the first fluid connector.

15. The side channel machine of claim 11, wherein the fluid outlet extends between the first fluid connection space and the second fluid connection space.

16. The side channel machine of claim 15, wherein the housing includes only a single seal.

17. The side channel machine of claim 11, wherein the fluid tight connection that is formed between the first fluid connector and the second fluid connector is formed without a seal.

18. A side channel machine for conveying a fluid, the side channel machine comprising:

a housing defining a fluid inlet fluidly coupled to a fluid outlet via a side channel configuration, the fluid inlet at least partially defined by a first fluid connector having a pair of opposed first and second limiting walls separated by a separating wall to cooperatively delimit a first fluid connection space and a second fluid connection space; and a second fluid connector including a first arm and a second arm configured to be received within the first fluid connection space and the second fluid connection space, respectively, and to form a fluid-tight connection with the first fluid connector, wherein the fluid inlet is disposed tangentially relative to the side channel configuration.

* * * * *